US005173019A

United States Patent [19]

Sdano

[11] Patent Number: 5,173,019

[45] Date of Patent: Dec. 22, 1992

[54] PUMP INCLUDING SECONDARY CONTAINMENT WITH ALARM SYSTEM

[75] Inventor: Arnold R. Sdano, Elkhart, Ind.

[73] Assignee: American Gage and Machine Company, Elgin, Ill.

[21] Appl. No.: 740,454

[22] Filed: Aug. 5, 1991

[51] Int. Cl.[5] ..... F04D 15/00; F04D 29/08

[52] U.S. Cl. ..... 415/118; 415/112; 415/168.2; 417/40; 60/455

[58] Field of Search ..... 415/118, 168.2, 110, 415/112; 60/455; 417/40

[56] References Cited

U.S. PATENT DOCUMENTS

| | | | |
|---|---|---|---|
| 1,520,939 | 12/1924 | Dorer | 415/118 |
| 2,371,250 | 3/1945 | Maroney | 415/168.2 |
| 2,584,705 | 2/1952 | Hornschuch | 415/118 |
| 3,085,808 | 4/1963 | Williams | 415/112 |
| 3,392,983 | 7/1968 | Hajner | 415/118 |
| 3,402,671 | 9/1968 | Wilfley et al. | 415/168.2 |
| 4,540,342 | 9/1985 | Steiner et al. | 417/40 |

*Primary Examiner*—Edward K. Look
*Assistant Examiner*—Michael S. Lee
*Attorney, Agent, or Firm*—Emrich & Dithmar

[57] ABSTRACT

A pump assembly including an impeller mounted on a shaft for rotation in an impeller casing to move liquid through the casing, the shaft being supported by bearings located in a bearing housing which contains bearing lubricating fluid, a primary seal providing a seal between the shaft and the impeller casing to prevent leakage of liquid from the casing, a secondary seal providing a seal between the shaft and the bearing housing to prevent leakage of lubricating fluid from the bearing housing and a containment vessel interposed between the impeller casing and the bearing housing connecting the impeller casing to the bearing housing and enclosing the primary seal and the secondary seal, the containment vessel having an orifice through a wall thereof for communicating the interior of the containment vessel with a storage container, the orifice being sized to pass liquid emissions from the primary seal during normal pumping operations to the storage container, but to restrict the amount of pumped liquid that is passed to the storage container, allowing the level of liquid to rise in the containment vessel when the primary seal fails, and a sensor located in the containment vessel for causing an alarm to be generated when the liquid reaches a given level.

18 Claims, 3 Drawing Sheets

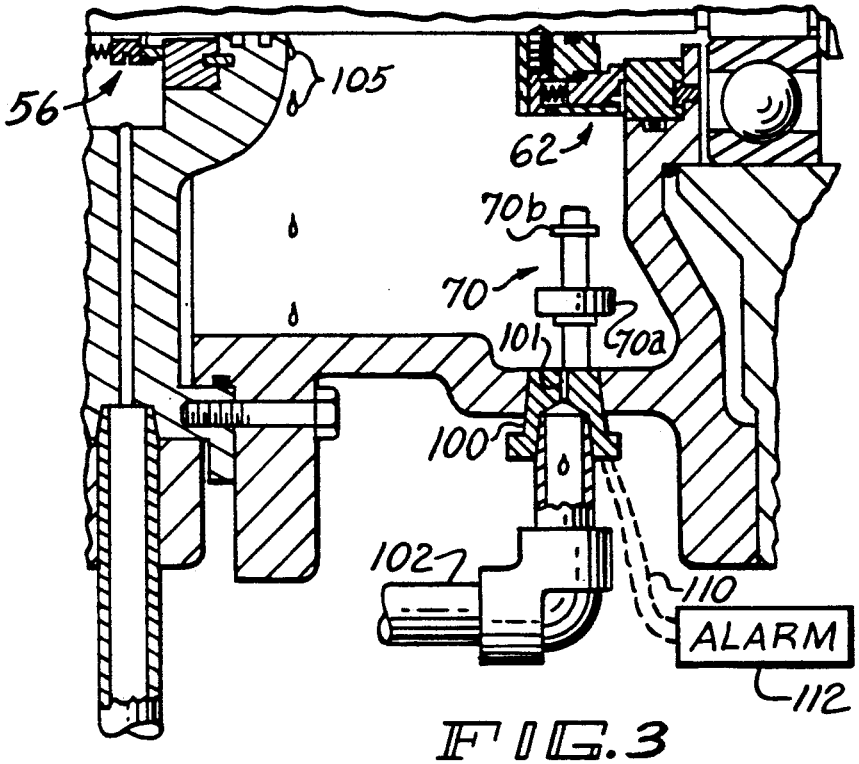
FIG. 3
FIG. 4
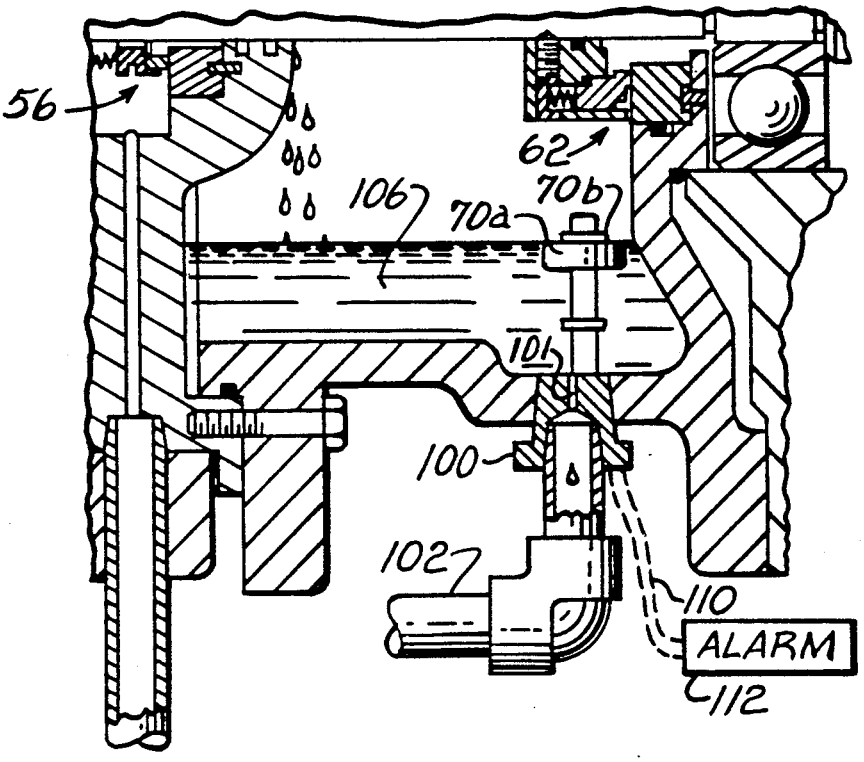

PUMP INCLUDING SECONDARY CONTAINMENT WITH ALARM SYSTEM

BACKGROUND OF THE INVENTION

This invention relates to pumps for pumping liquids, and more particularly to a pump assembly having added leak protection.

One type of pump available at present includes an impeller casing having a fluid inlet and a fluid outlet with an impeller located within the casing for moving the fluid through the casing from the inlet to the outlet. The impeller is mounted on and rotated by a shaft which is driven by a motor externally of the impeller casing, with the shaft penetrating the impeller casing. The shaft and impeller carried thereby are supported by bearings which are located within a bearing housing which provides for lubrication of the bearings. The impeller casing is attached to the bearing housing by an adaptor. This "modular" arrangement provides substantial flexibility by permitting many pump assemblies with different operating parameters to be produced by combining different impeller assemblies and bearing assemblies. The number of parts stocked by a manufacturer is greatly reduced while a large number of different pump assemblies can be provided.

The impeller casing has a seal at its driven end which, for example, may include a seal or packing and an appropriate gland. This seal prevents leakage of the liquid being pumped by the pump. The bearing housing has inboard and outboard seals to prevent lubricating oil from leaking from the bearing housing. Because of the "open-back" construction, failure of either one of the seals will result in leakage of the fluid being pumped or bearing lubrication oil, requiring shutdown of the pump and disruption of the pumping process until the leakage can be repaired. Because the pump must be shut down as soon as the leakage is detected, the repair cannot be scheduled prior to shutting down of the pump.

Recently, the Environmental Protection Agency has issued more stringent standards for pumps which are used to pump certain hazardous fluids. For example, the standards for light liquid service require dual mechanical seal systems and a barrier fluid system with each dual mechanical seal system. Also, the barrier fluid system must be operated with the barrier fluid at a pressure that is at all times greater than the pump stuffing box pressure or equipped with a barrier fluid degassing reservoir that is connected by a closed-vent system to a control device. An alternative requirement is that the pump be designed with no externally actuated shaft penetrating the impeller casing.

Accordingly, it would be highly desirable to have a pump assembly which includes the flexibility of existing modular pump assemblies, but which is further characterized by improved protection against leakage and is well suited to meet the new regulations being issued by the Environmental Protection Agency.

SUMMARY OF THE INVENTION

It is therefore an object of the present invention to provide an improved pump assembly.

A further object of the present invention is to provide a pump assembly which is characterized by improved protection against leakage as compared to existing pump assemblies and which meets Environmental Protection Agency standards.

Another object of the present invention is to provide a improved pump assembly which permits leak free operation of the pump assembly after the primary seal has failed.

Another object of the present invention is to provide an improved pump assembly which provides an indication of failure of the seal system of the pump.

Yet another object of the present invention is to improve the life expectancy of the second seal by locating it adjacent to a bearing, minimizing wear causing deflection and providing oil lubrication to the seal faces.

These and other objects are achieved by the present invention which provides an improved pump assembly including an impeller enclosed within a casing and mounted on a shaft for rotation to move liquid through the casing from an inlet to an outlet thereof. The shaft is supported by bearings which are located in a bearing housing containing bearing lubricating fluid. A first seal means provides a fluid seal between the shaft and the impeller casing. A second seal means provides a fluid seal between the shaft and the bearing housing. A containment means is interposed between the impeller casing and the bearing housing with a portion of the shaft passing through the containment means. The containment means, connecting the impeller casing to the bearing housing, maintains a predetermined spacing therebetween and maintains alignment between the shaft and the impeller. The containment means encloses the shaft portion and the first and second seal means and defines an inner compartment for holding any leaked pumped liquid. The compartment has flow control means for communicating the compartment with a liquid storage container. The flow control means is constructed and arranged to pass liquid emissions from the first seal means to the storage container during normal pumping operations, but to restrict the amount of pumped liquid that is passed to the storage container when the first seal means fails. Further in accordance with the present invention, the flow control means causes a change in a condition in the compartment when the first seal means fails and the pump assembly includes a sensing means responsive to the change in condition to cause an alarm to be generated.

The invention consists of certain novel features and structural details hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

FIG. 3 is a fragmentary view of the pump assembly of FIG. 2 illustrating the liquid sensor in the unoperated condition in accordance with the present invention; and FIG. 4 is a view similar to that of FIG. 3, but with the liquid sensor operated in accordance with the present invention.

DESCRIPTION OF A PREFERRED EMBODIMENT

Figure 1:
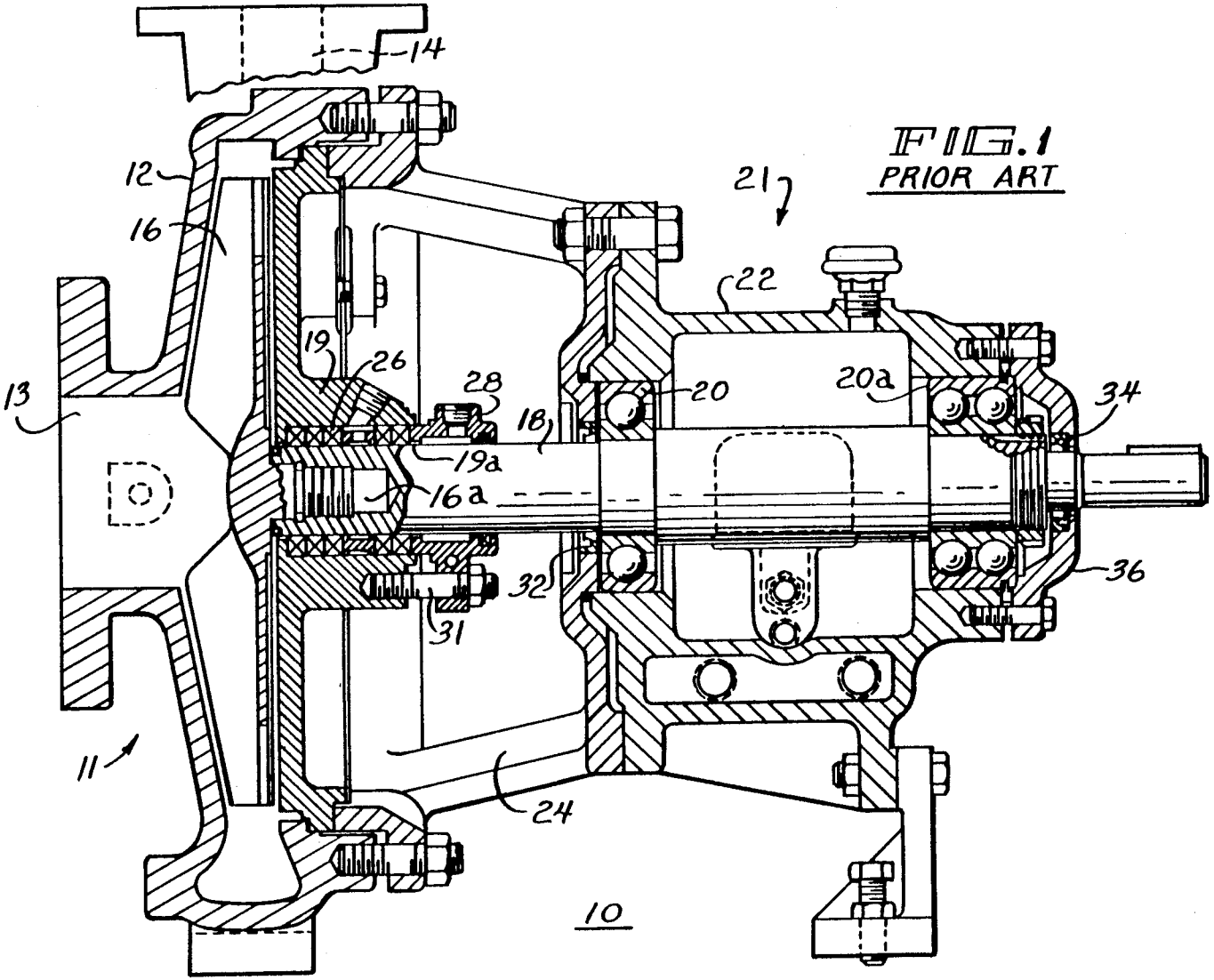
FIG. 1 PRIOR ART
FIG. 1 which is labeled prior art, is a side sectional view of a known pump assembly.

Referring to FIG. 1, there is illustrated, in section, a process pump assembly 10 which is commercially available, for example, as the model A-50TF from LaBour Pump Company of Elkhart, Ind. 46515. Pump assembly 10 includes impeller assembly 11 and a bearing assembly 21 connected together by an adaptor 24. The impeller assembly 11 includes a housing or casing 12 having a liquid inlet port 13 and a liquid outlet port 14 and an impeller 16 located in the casing 12 for moving the fluid through the casing from its inlet port to its outlet port. The impeller 16 is mounted on a shaft 18 which is driven by a motor (not shown) for rotating the impeller 16 within the casing 12. The shaft 18 is supported by bearings 20 and 20*a* of bearing assembly 21 and which are located within a bearing housing 22 of the bearing assembly 21 which contains a suitable lubricating oil. The casing 12 is mounted on the bearing housing 22 by an adaptor 24 which aligns the center line of the shaft 18 with the center line of the impeller mounting shaft 16*a*. The open back of the impeller casing 12 is closed by a stuffing box cover 19 having a central opening 19*a* through which passes the distal end of the shaft 18. The cover 19 is secured to the casing 12 by the adaptor 24.

For the purpose of providing a seal between the shaft 18 and the back side of the impeller casing 12 which is defined by the stuffing box cover 19, there is provided packing or seal 26 and an appropriate gland 28. The packing or seal 26 is maintained in place by the stuffing box cover 19. The appropriate gland 28 is secured to the stuffing box cover 19 by bolts, such as bolt 31. The seal formed by the packing or seal 26 and the appropriate gland 28 prevents fluid being pumped by the impeller 16 from leaking out of the impeller casing along the junction of the shaft 18 and the opening 19*a* in the cover 19.

The bearing housing 22 includes an inboard oil seal 32 and an outboard oil seal 34 for preventing leakage of the lubrication oil from the interior of the bearing housing 22. The bearing housing includes a bearing cover 36 which encloses the outboard end of the shaft 18.

One advantage of the pump assembly 10 is its modular design which permits different impeller assemblies 11 including different combinations of impellers and impeller housings or casings, to be used with a common bearing assembly 21, enabling the pump assembly to be configured for varying operating conditions and parameters while requiring the manufacturer to stock a minimum number of parts and/or subassemblies. However, a shortcoming of this pump assembly is that if a leak should develop in the primary seal, the pump assembly must be shut down, resulting in a disruption of the process until the pump assembly can be repaired.

Figure 2:
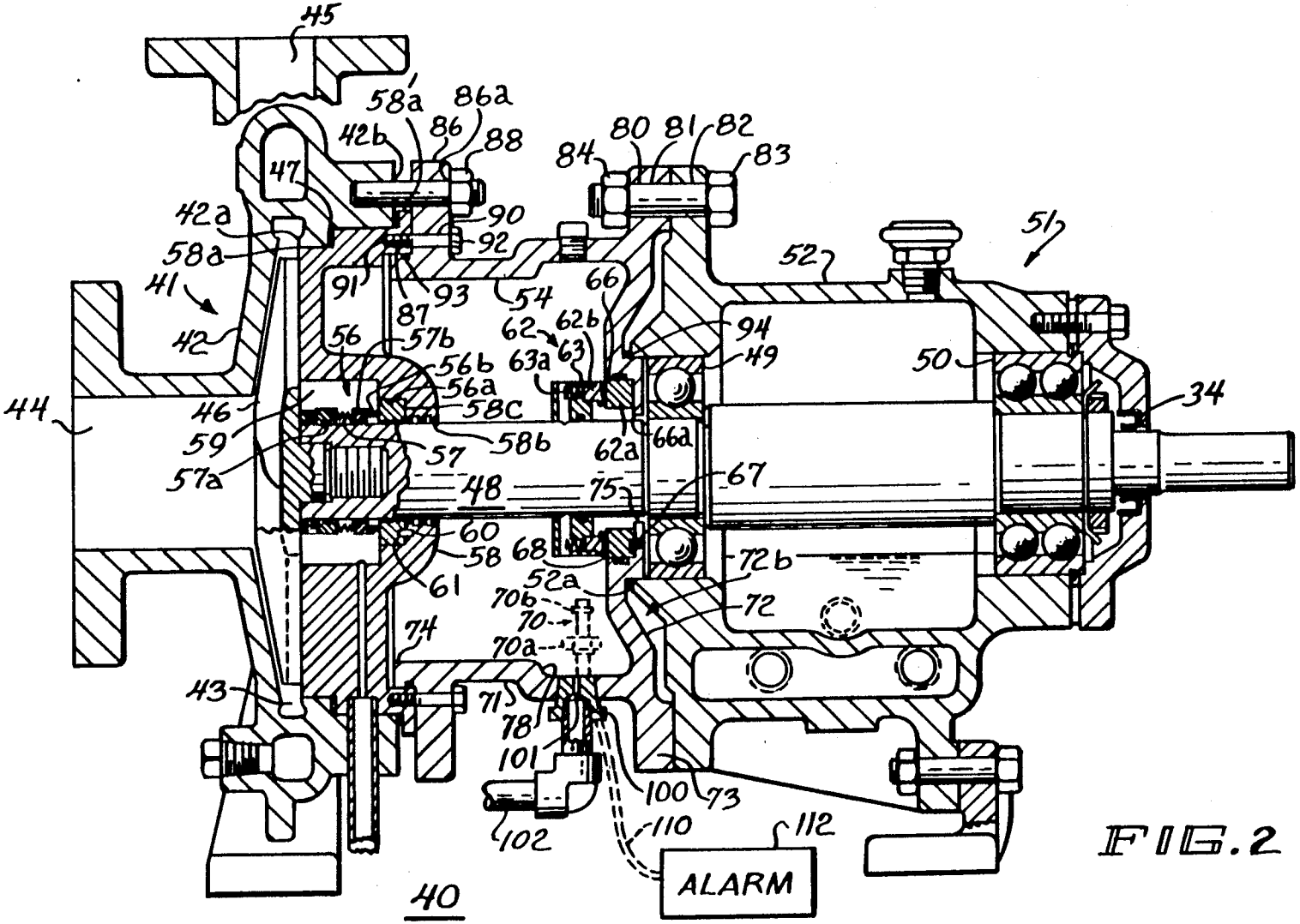
FIG. 2 is a side sectional view of a pump assembly provided by the present invention.

Referring now to FIG. 2, there is illustrated a pump assembly 40 provided by the present invention. The pump assembly 40 includes an impeller assembly 41 and a bearing assembly 51 which are generally similar to impeller assembly 11 and bearing assembly 21 of the pump assembly 10. The pump assembly 40 includes mechanical seals, including a primary seal 56 and a secondary seal 62, for sealing the impeller assembly 41 and bearing assembly 51, respectively. In addition, the pump assembly 40 includes a secondary containment vessel 54 which provides the function of the adapter 24 for the pump assembly 10. The secondary containment vessel 5 maintains the distance and aligning of the rotating assembly, such as the shaft 48, the rotating seals and the impeller with respect to the stationary components, such as the casing 42, the bearing housing 52 and the fixed seals. Also, the secondary containment vessel 54 provides a fully enclosed pressure tight area which prevents external releases of the pumpage if the primary seal 56 should fail. Moreover, the secondary containment vessel 54 provides a holding area to retain the leakage from a failed primary seal 56. A liquid sensor 70 is mounted on the secondary containment vessel 54 and located within the chamber defined by the secondary containment vessel to provide a warning when abnormal leakage from the primary seal occurs. The primary seal 56 controls leakage of the pumpage from the interior of the impeller casing 42 into the chamber defined by the secondary containment vessel. The secondary seal 62 retains the lubricating oil in the bearing housing 52 during normal operation. In the event of failure of the primary seal, the secondary seal prevents pumpage that has entered the secondary containment vessel 54 from passing into the bearing housing 52.

Considering the pump assembly 40 in more detail, the impeller assembly 41 includes an open back casing 42 and a cover 58 which encloses the casing open back, defining an inner chamber 43 in which the impeller 46 is located. The cover 58 has a stepped mounting surface 58*a* which engages complementary shaped surface 42*a* of the casing 42, there being a gasket 47 between mating surfaces thereof. The casing 42 has a liquid inlet port 44 and a liquid outlet port 45.

The impeller is mounted on the shaft 48 and rotated therewith to draw pumpage through the inlet port 44 and discharge it through the outlet port 45.

The distal end of the shaft passes through an opening 58*b* in the cover 58 and is secured to the impeller. The shaft 48 is supported by inboard bearing 49 and outboard bearing 50 which are located within the bearing housing 52 which contains lubricating oil for lubricating the bearings.

The primary seal 56 prevents leakage of pumpage from the impeller casing 42 by providing a seal at the location where the shaft passes through cover 58. The primary seal 56 includes a fixed seal member 56*a*, a rotating seal member 56*b*, a spring 57, a sleeve 57*a* and a collar 57*b*. The fixed seal member 56*a* is mounted in an annular channel 58*c* formed on the inner surface of the cover 58 which encloses the open back of the casing 42 and defines the inner chamber 43. The cover 58 further defines a seal chamber 59 in which the primary seal 56 is located. The rotating seal member 56*b* is mounted on the shaft 48 and maintained in engagement with the seal surface of the fixed seal member 56 by the spring 57 which is located between the shaft mounted sleeve 57*a* and a spacer collar 57*b*. The fixed seal member 56*a* is indexed to the cover 58 by a pin 60. An O-ring 61 provides a seal between the fixed seal member and the cover.

The secondary seal 62 prevents leakage of lubricating oil from the bearing housing 52 at its inboard end. The secondary seal 62 includes a fixed seal member 62*a* and a rotating seal member 62*b*, a mounting collar 63 and a spring 63*a*. The fixed seal member 62*a* is mounted in a channel 66 formed in the stationary containment vessel and indexed to the stationary vessel by a pin 67. An O-ring 68 is interposed between the fixed seal member 62*a* and the containment vessel 54. The collar 63 is mounted on the shaft and secured thereto for rotation with the shaft. The collar defines an annular compartment in which is mounted the rotating seal member 62*b*. The spring 63*a* is interposed between the rotating member 62*b* and the collar 63 to bias the seal member into engagement with the fixed seal member 62*a*. A conventional oil seal 34 is provided at the outboard end of the bearing housing 52 to prevent leakage of lubrication oil from the bearing housing.

The secondary seal 62 is a dry running seal, the function of which is to retain the oil in the bearing housing 52 during normal operation. In the event of failure of the primary seal, the secondary seal prevents the pumpage that has entered the secondary containment vessel 54 from passing through to the bearing housing. One of the problems with dry running seals is that they can prematurely fail due to deflection of the shaft. In accordance with the invention, the secondary seal is located much closer to the inboard bearing 49 than would be found in a typical pump designed for the chemical or petroleum industry, for example. Locating the secondary seal at the bearing 49 prevents the problem of the shaft deflection. Another feature of this design is that the occasional splashing of oil from the bearing housing will serve to cool and lubricate the seal faces, thus increasing the seal life.

The secondary containment vessel 54 is a generally hollow cylindrical member having a side wall 71 and an end wall 72 at one end 73 adjacent to the bearing assembly 51. The containment vessel is open ended at its other end 74 adjacent to the impeller assembly 41. The end wall 72 has an aperture 75 therethrough through which the shaft 48 passes. The inner surface of the end wall 72 adjacent to the aperture 75 is stepped, defining an annular shoulder 66*a* which mounts the fixed seal member 62*a*. The side wall 71 is preferably stepped outwardly near its end 73, defining an annular channel 78 interior of the containment vessel.

For the purpose of securing the containment vessel to the bearing housing 52, the containment vessel defines an annular mounting flange 80 which extends radially outward from its side 71 near its end 73 that is adjacent to the bearing assembly 51. The mounting flange includes a plurality of apertures, such as aperture 81 which is aligned with apertures such as aperture 82 in the bearing housing flange and secured thereto in a suitable manner as by bolt 83 and nut 84. While only one set of aligned mounting apertures and mounting hardware is illustrated, the containment vessel is secured to the bearing housing at a plurality of locations along the periphery of its mounting flange. The containment vessel has a further mounting flange 86 near its end 74 that is adjacent to the casing 42, extending radially outward therefrom to facilitate attachment to the casing 42. The flange 86 has a plurality of apertures, such as aperture 86*a* which is aligned with an aperture 42*b* in the casing 42 and secured thereto in a suitable manner as by bolt 88, a plurality of such connections being provided around the annular flange 86. The flange 86 is offset inwardly relative to the end 74 of the containment vessel 54 to define a shoulder 87 which receives the annular mounting end 58*a* of the cover 58. The flange 86 has a plurality of apertures, such as aperture 90, spaced radially inward from apertures 86*a* which are aligned with corresponding apertures 91 in the cover 58 and secured thereto by bolts 92. An O-ring 93 is located between mating surfaces of the cover 58 and the end 74 of the containment vessel.

The outer surface 72*b* of the end wall 72 near the aperture 75 is recessed, defining a mounting surface for receiving the annular end 52*a* of the bearing housing 52. An O-ring 9 is interposed between mating surfaces of the end wall 72 and bearing housing 52.

The secondary containment vessel 5 mounts the impeller assembly 41 to the bearing assembly 51 and maintains a desired spacing therebetween. The containment vessel also maintains alignment of the rotating elements with respect to the stationary components. In addition, the containment vessel 54 defines a fully enclosed pressure tight area which prevents external releases of the pumpage should the primary seal 56 fail during the pumping operation. The containment vessel 54 also provides a holding are to retain leakage from the impeller casing 42 should the primary seal 56 fail.

A vent orifice member 100 is mounted in the side wall 71 of the containment vessel 54 in the annular channel portion 78 thereof. The vent orifice member 100 has an orifice 101 which is communicated with vent piping 102 to conduct liquid through the orifice member 100 to a suitable emission abatement system (not shown).

The liquid sensor 70 is a miniature magnetic float switch including a float 70*a*. The sensor switch 70 is oriented vertically and the float is movable vertically upward with accumulation of liquid in the containment vessel. When the float 70*a* reaches its upper limit of travel, it engages contacts 70*b*, closing a switch between conductors 110 which are connected to a suitable alarm indicator 112. Although a miniature magnetic float switch is illustrated, the liquid sensor could be any variety of liquid sensors commonly in use. Also, although the switch operates on the basis of detecting rise in liquid level, the switch may detect pressure change or change in conductivity in generating its alarm function. Moreover, although a single liquid sensor is illustrated, multiple liquid sensors of similar or various types may be provided to provide additional protection through redundancy.

Referring to FIG. 3, the orifice 101 of orifice member 100 is sized to accommodate normal slight leakage, indicated at 105, past the primary seal 56. During normal operation, the amount of emissions 105 from the primary seal 56 are passed through the orifice 101 to the abatement system (not shown).

Referring to FIG. 4, in the event that the primary seal 56 should fail, pumpage accumulates in the secondary containment vessel as indicated at 106. The orifice 101 restricts the amount of leakage that is passed to the emission abatement system allowing the level to rise in the secondary containment vessel 54. As the level rises, the float 70*a* of the sensor switch 70 rises and enables alarm indicator 112 to generate an alarm when the float 70*a* closes contacts 70*b* upon reaching the upper extent of its travel. The secondary seal 62 and the secondary containment vessel 54 prevent an external releases.

I claim:

1. In a pump assembly having a fluid barrier assembly and including an impeller enclosed within a casing and mounted on a shaft for rotation to move liquid through the casing from an inlet to an outlet thereof, the shaft being supported by bearings located in a bearing housing containing bearing lubricating fluid, first seal means providing a fluid seal between the shaft and the impeller casing to prevent liquid flow therebetween, second seal means providing a fluid seal between the shaft and the bearing housing, the fluid barrier assembly comprising: containment means interposed between the impeller casing and the bearing housing with a portion of the shaft passing through said containment means, said containment means connecting the impeller casing to the bearing housing and said containment means maintaining a predetermined spacing therebetween and maintaining alignment between the shaft and the impeller, said containment means enclosing said shaft portion and said first and second seal means and defining an inner compartment for retaining liquid which passes the first seal means into said compartment, said compartment having flow control means for communicating said compartment with a liquid storage container, said flow control means being constructed and arranged to pass liquid emissions from said first seal means to the storage container during normal pumping operations, but to restrict the amount of pumped liquid that is passed to the storage container when said first seal means fails.

2. The pump assembly according to claim 1, wherein said flow control means comprises an orifice sized to pass to the storage container leaked liquid emitted through said first seal means at a predetermined flow rate, but to cause leaked liquid to accumulate in said compartment when the flow rate of the leaked liquid exceeds said predetermined rate.

3. The pump assembly according to claim 1, wherein said containment means comprises a hollow cylindrical member having a side wall with a first end portion secured to the bearing housing and a second end portion secured to the impeller casing, said cylindrical member enclosing the space between the bearing housing and the impeller casing.

4. The pump assembly according to claim 3, wherein said first end portion of said cylindrical member defines an annular mounting shoulder, the second seal means including a fixed seal member mounted on said shoulder and a rotating seal member mounted on the shaft.

5. The pump assembly according to claim 3, wherein said first end portion of said cylindrical member includes mounting means for removably securing said first end portion to the bearing housing and said second end portion of said cylindrical member includes mounting means for removably securing said second end portion to the impeller casing.

6. The pump assembly according to claim 3 wherein the first and second seal means define a tandem seal for preventing liquid from entering the bearing housing.

7. The pump assembly according to claim 1, wherein said flow control means causes a rise in the level of liquid in said compartment when said first seal means fails.

8. The pump assembly according to claim 7, further including level sensing means for causing an alarm to be generated when the liquid in said compartment reaches a predetermined level.

9. In a pump assembly including an impeller enclosed within a casing and mounted on a shaft for rotation to move liquid through the casing from an inlet to an outlet thereof, the shaft being supported by bearings located in a bearing housing containing bearing lubricating fluid, first seal means providing a fluid seal between the shaft and the impeller casing, second seal means providing a fluid seal between the shaft and the bearing housing, the combination comprising: containment means interposed between the impeller casing and the bearing housing with a portion of the shaft passing through said containment means, said containment means connecting the impeller casing to the bearing housing, and said containment means maintaining a predetermined spacing therebetween and maintaining alignment between the shaft and the impeller, said containment means enclosing said shaft portion and said first and second seal means and defining an inner compartment for holding liquid, said compartment having flow control means for communicating said compartment with a liquid storage container, said flow control means being constructed and arranged to pass liquid emissions from said first seal means to the storage container during normal pumping operations, but to restrict the amount of pumped liquid that is passed to the storage container, causing a change in a condition in the compartment, when said first seal means fails, and sensing means responsive to a change in said condition in said containment vessel for causing an alarm to be generated.

10. The pump assembly according to claim 9, wherein said flow control means comprises an orifice sized to pass to the storage container leaked liquid emitted through said first seal means at a predetermined flow rate, but to cause leaked liquid to accumulate in said compartment when the flow rate of leaked liquid exceeds said predetermined rate.

11. The pump assembly according to claim 9, wherein said containment means comprises a hollow cylindrical member having a side wall with a first end portion secured to the bearing housing and a second end portion secured to the impeller casing, said cylindrical member enclosing the space between the bearing housing and the impeller casing.

12. The pump assembly according to claim 11, wherein said first end portion of said cylindrical member defines an annular mounting shoulder, the second seal means including a fixed seal member mounted on said shoulder and a rotating seal member mounted on the shaft.

13. The pump assembly according to claim 11, wherein said first end portion of said cylindrical member includes mounting means for removably securing said first end portion to the bearing housing and said second end portion of said cylindrical member includes mounting means for removably securing said second end portion to the impeller casing.

14. The pump assembly according to claim 11, wherein the first and second seal means define a tandem seal for preventing liquid from entering the bearing housing.

15. The pump assembly according to claim 9, wherein said change in condition comprises a rise in the level of liquid in said compartment, said sensing means comprising level sensing means for causing an alarm to be generated when the liquid in said compartment reaches a predetermined level.

16. The pump assembly according to claim 15, wherein said level sensing means comprises a magnetic float switch having a float which is moved vertically upward to engage contact means when the liquid in said compartment reaches said predetermined level.

17. In a pump assembly including an impeller enclosed within a casing and mounted on a shaft for rotation to move liquid through the casing from an inlet to an outlet thereof, the shaft being supported by bearings located in a bearing housing containing bearing lubricating fluid, first seal means providing a fluid seal between the shaft and the impeller casing, second seal means providing a fluid seal between the shaft and the bearing housing, the combination comprising: containment means interposed between the impeller casing and the bearing housing with a portion of the shaft passing through said containment means, said containment means connecting the impeller casing to the bearing housing, and said containment means maintaining a predetermined spacing therebetween and maintaining alignment between the shaft and the impeller, said containment means enclosing said shaft portion and said first and second seal means and defining an inner compartment for holding liquid, said compartment having a wall portion with an orifice therethrough for communicating said compartment with a liquid storage container, said orifice being constructed and arranged to pass liquid emissions from said first seal means to the storage container during normal pumping operations, but to restrict the amount of pumped liquid that is passed to the storage container, causing the level of liquid to rise in said compartment, when said first seal means fails, and sensing means in said containment vessel for causing an alarm to be generated when the level of liquid in said compartment reaches a given level.

18. The pump assembly according to claim 17, wherein said sensing means comprises level sensing means.

* * * * *

UNITED STATES PATENT AND TRADEMARK OFFICE

CERTIFICATE OF CORRECTION

PATENT NO. : 5,173,019

DATED : December 22, 1992

INVENTOR(S) : Arnold R. Sdano

It is certified that error appears in the above-identified patent and that said Letters Patent is hereby corrected as shown below:

| COLUMN | LINE | |
|---|---|---|
| 4 | 2 | after vessel delete "5", and insert --54--. |
| 6 | 4 | after O-ring delete "9", and insert --94--. |
| 6 | 6 | after containment vessel delete "5" and insert -- 54 --. |

Signed and Sealed this

Nineteenth Day of October, 1993

Bruce Lehman

*Attest:*

BRUCE LEHMAN

*Attesting Officer*

*Commissioner of Patents and Trademarks*